United States Patent [19]

Reinhall

[11] 4,283,252

[45] Aug. 11, 1981

[54] METHOD AND APPARATUS FOR PRODUCING FIBER PULP FROM FIBROUS LIGNOCELLULOSE CONTAINING MATERIAL

[76] Inventor: Rolf B. Reinhall, P.O. Box 3847, Bellevue, Wash. 98009

[21] Appl. No.: 160,253

[22] Filed: Jun. 17, 1980

Related U.S. Application Data

[63] Continuation of Ser. No. 937,411, Aug. 28, 1978, abandoned, which is a continuation of Ser. No. 777,624, Mar. 15, 1977, abandoned.

[30] Foreign Application Priority Data

Mar. 19, 1976 [SE] Sweden ..... 7603464

[51] Int. Cl.[3] ..... D21B 1/14; B02C 23/24

[52] U.S. Cl. ..... 162/23; 162/68; 241/18; 241/23; 241/28

[58] Field of Search ..... 162/23, 68, 254; 241/18, 21, 23, 17, 38, 28, 244, 245, 246, 247

[56] References Cited

U.S. PATENT DOCUMENTS

| | | | |
|---|---|---|---|
| 2,396,587 | 3/1946 | Lowgren et al. | 241/247 |
| 3,215,355 | 11/1965 | Shouvin et al. | 241/247 |
| 3,910,505 | 10/1975 | Reinhall | 241/18 |

OTHER PUBLICATIONS

Defibrator News, 1:1974, pp. 1–12.

*Primary Examiner*—Peter Chin
*Attorney, Agent, or Firm*—Eric Y. Munson

[57] ABSTRACT

Method and apparatus for producing thermo-mechanical pulp from wood chips and the like in which the chips are first heated in a steaming chamber or preheater to a fiber temperature below the softening point of the lignin of middle lamella section of the wood fibers. The thus heated chips are conveyed in a sealed system to the inlet of a difibrating zone enclosed within a housing in a gaseous atmosphere of superatmospheric pressure, where it is compressed by a screw conveyor into a plug which seals the defibrator housing against blow-back of the pressurized gaseous medium. The defibrating space is defined between a pair of grinding discs which rotate relatively to one another in the housing and comprises a first substantially central zone into which the compressed plug is advanced by the compressor screw and broken up and the fibers subjected to an initial defibration step at a fiber temperature below the softening point of the lignin, to cause the fibers to unravel and to expose the different fiber layers without any substantial separation thereof. As the fiber bundles progress radially outwards under the centrifugal force of the rotating discs into a second zone radially surrounding the first zone, the temperature increases by the heat of the grinding friction which converts water accompanying the chips into high temperature, high pressure steam, in which environment the lignin is softened so that the wood structure is broken in the lignin-rich middle lamella section of the fibers to permit the fibers to become completely separated and fibrillated in undamaged condition. The resultant pulp is discharged from the pressurized housing through a blow valve which is adjustable to control the pressure and temperature within the defibrator housing.

3 Claims, 2 Drawing Figures

METHOD AND APPARATUS FOR PRODUCING FIBER PULP FROM FIBROUS LIGNOCELLULOSE CONTAINING MATERIAL

This is a continuation, of application Ser. No. 937,411 filed Aug. 28, 1978, abandoned which is a continuation of Ser. No. 777,624, filed Mar. 15, 1977, abandoned.

BACKGROUND OF THE INVENTION

This invention relates to a method for producing pulp from fibrous ligno-cellulose containing material, in which the pulp material, such as wood chips, is disintegrated in a grinding apparatus which comprises at least two opposing grinding discs which rotate relatively to one another under axial pressure within a housing. The material is introduced from a supply passage into the grinding space between the discs at the inner radial portion thereof and is propelled outwards in an atmosphere of steam or gas.

The supply passage usually includes a vessel in which the material to be ground is preheated by a heating medium, such as steam, under atmospheric or higher pressure, before it is fed into the grinding space.

It is known that the fiber pulp in this manner acquires favorable properties for production of paper and the like, namely, with regard to brightness and strength, if the grinding process is carried out at a temperature ranging between 100° C. and 140° C. preferably 118° C.–125° C., and at a corresponding steam pressure, since the treatment is of short duration and the concentration or dryness of the pulp is relatively high, such as 15%–14%. A further advantage with this so-called thermo-mechanical pulping method is that chemicals can be dispensed with to a substantial degree, which is important for environmental reasons, among others.

SUMMARY OF THE INVENTION

The invention contemplates a novel method for producing fiber pulp which can be carried out in a substantially simplified apparatus for preheating and process control, while still imparting to the final pulp the same or even better properties than those obtained by the above-described thermo-mechanical method. The invention is based on the concept that the separation of the fibers is dependent on the temperature to which the middle lamellae, by which the fibers are bonded together, are heated during the initial state. The middle lamellae, which surround the different fiber walls, are rich in lignin, which, during heating, are successively transformed from a hard or rigid condition into a more semi-rigid state, in order thereafter to acquire a gradually increasing degree of stickiness. When referring to the softening point herein, it should be understood that this means that temperature range within which the middle lamella still has such hardness that the fiber separation takes place essentially by unravelling of the different layers of the fiber wall. On the other hand, if the grinding process should start after the temperature of the lignin-containing middle lamella has reached the softening point, the middle lamella forms a sticky coating on the outermost fiber layer, namely, the primary layer, which makes the subsequent grinding substantially more difficult, with consequent impairment of the final results.

Heretofore, the raw material has been fed from a preheater or steaming chamber to the inlet side of the grinding space by conveyor means, such as a screw conveyor, and sometimes in combination with dewatering of the material, which results only in a limited compression of the material, so that, when the grinding operation takes place in a steam environment, there is a relatively free flow of steam through the conveyor means. This observation holds true regardless of whether the steam pressure in the steaming chamber is higher than in the grinding apparatus, in which case the steam flows through the conveyor in the same direction as the material, or whether the steam pressure in the grinding apparatus is higher than in the preheater or steaming chamber, so that the steam flows in a direction opposite to that of the material. In the latter case, the steam flow results from steam generated between the grinding discs during the grinding operation by partial conversion of the great amount of mechanical energy into heat. In either case, in the known methods, the initial grinding phase will be carried out in a steam atmosphere which will raise the temperature of the material upon its entry into a first zone of the grinding space towards the softening point of the middle lamella.

The invention is essentially characterized by the feature that the supply passage and/or the steaming chamber are separated from the inlet of the grinding space in a steam-tight manner by the pulp material itself.

By reason of this steam-tight seal, pressurized steam or gas at the inlet opening is prevented from being blown back through the inlet and from coming in contact with the advancing material before it reaches a space which is in direct communication with a space at the inlet end of the grinding space.

Another feature of the invention is that the pulp material is compressed before it is introduced into the grinding space and preferably dewatered to such a degree as to form a steam-tight plug. Preferably, the pulp material, during its passage from the supply passage to the grinding apparatus, is kept at such a temperature that the softening point of the middle lamella will first be reached after the material has passed into an inner zone and undergone a grinding operation therein. Due to the short dwell-time in the steam atmosphere, the temperature of the material during the initial grinding will not go so high as to reach the softening point of the middle lamella, but will be kept safely below this temperature. Thus, the material in the first grinding zone can essentially be maintained at the same temperature that it has in the supply passage and steaming chamber. In this manner, the fibers are unravelled during the initial grinding to expose the different fiber layers or fiber walls. As the material proceeds radially outward into the grinding space, the temperature is increased by the generated steam to produce the required treatment condition for complete fiber separation and fibrillation, resulting in a fiber pulp which has extraordinary properties which make it useful particularly for paper making. The method according to the invention results in improved fibrillation and swelling of the fibers, while maintaining the fiber length intact. In comparison with the aforementioned thermo-mechanical pulping method, the final result will be improved due to the fact that the preheating or steaming step can take place at a temperature level where the middle lamella is softened to such a degree that the fiber separation takes place in the fiber wall under conditions which to a high degree favorably affect the properties of the final pulp.

The supply passage formed with a steaming chamber is supplied with a heating medium preferably steam, so as to establish a temperature therein of not more than 100° C. Superatmospheric pressure is maintained in the grinding apparatus which can be produced entirely by the steam generated during the grinding operation. The amount of energy consumed by the rotating disc or discs of the grinding apparatus is great and is converted by friction, etc., partly into heat, which causes the water accompanying the pulp material in the grinding space to be converted into steam. This superatmospheric steam pressure can be maintained at a predetermined value in known manner by a sensor for controlling the discharge area in a blow valve located in the discharge duct of the grinding housing.

BRIEF DESCRIPTION OF THE DRAWINGS

The invention is described in greater detail with reference to the accompanying drawings, in which.

DESCRIPTION OF A PREFERRED EMBODIMENT

Figure 1:
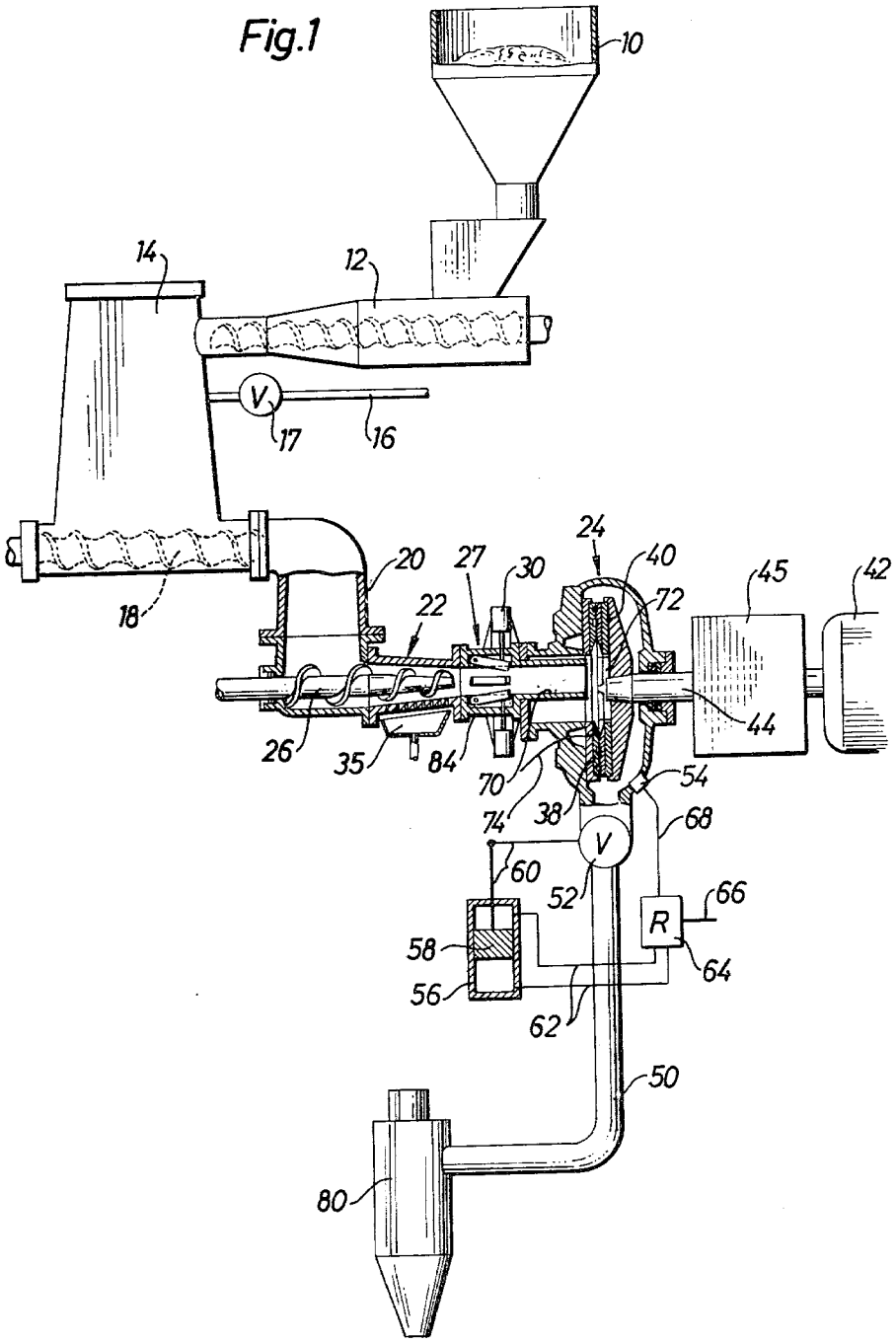
FIG. 1 is a schematic side view partly in section, showing an apparatus for carrying out the invention.
Figure 2:
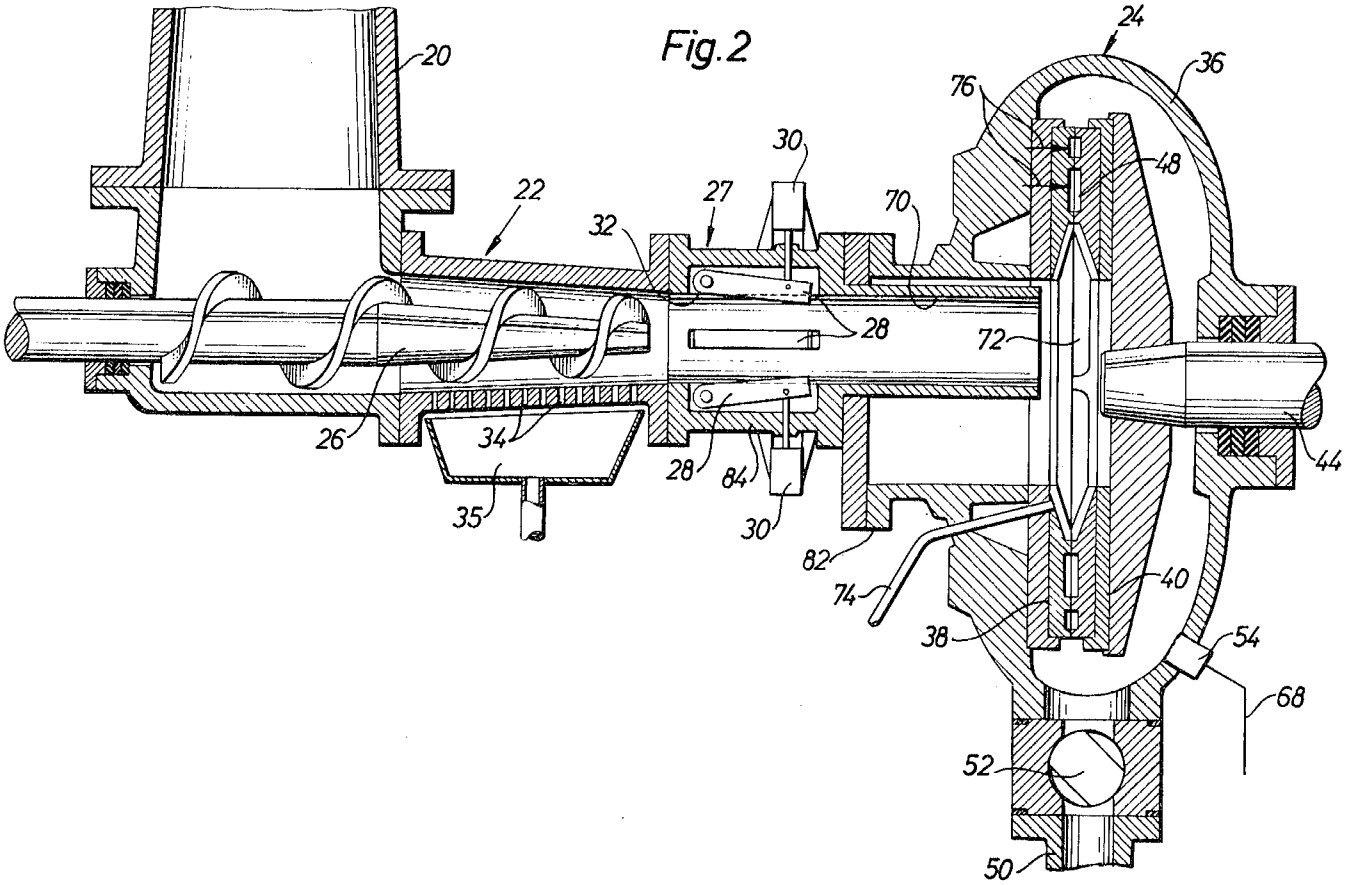
FIG. 2 is a partial sectional view of the apparatus shown in FIG. 1, drawn to an enlarged scale.

The reference numeral 10 designates a hopper or bin for the raw material, such as wood chips, which are conveyed by the screw conveyor 12 into the steaming chamber 14, in which the chips are heated to a temperature not exceeding 100° C., for example, by steam, which is introduced through the conduit 16 equipped with a valve 17. The steaming chamber is preferably under atmospheric pressure. The chips are conveyed by screw conveyor 18 in the bottom of the steaming chamber 14 to the grinding apparatus or defibrator 24. In the illustrated embodiment, the compressor throat 22 has a conical bore tapering in the direction of the movement of the material, within which the screw 26 of correspondingly conical profile is rotatably disposed. To the outlet end of the throat 22, is connected a counterpressure member 27, which may be a tubular connector piece 84 within which vanes or flaps 28 are pivotally disposed for actuation by the piston servomotor 30, so as to be swung into the inner bore 32 of the connector piece, which bore suitably forms a cylindrical extension of the end of the screw compressor 26. In this manner, the cross-sectional flow area of the bore can be reduced with resultant high degree of compression of the pulp material, such as wood chips. The pulp material normally contains water, which, during the compression is pressed out through the perforations 34 in the throat 22 and removed through the funnel 35.

The grinding apparatus or defibrator 24 comprises a pair of grinding discs which are disposed in the housing 36. In the example illustrated, one of the discs 38 is stationary and connected to the housing, while disc 40 is mounted on drive shaft 44, which is driven by a motor 42. A servo motor 45 is disposed between the motor and the rotating grinding disc 49, in known manner, as shown, for example, in Swedish Pat. No. 179,337, which servo-motor, by means of an axially displaceable non-rotatable piston, transmits the pressure of a hydraulic pressure medium through bearings to the rotating axel 44 in order to create the high pressure which is required for grinding the material as it passes radially outward in the grinding space 48 between the two facing grinding discs.

A conduit 50 equipped with a blow valve 52 is connected to the bottom of grinding housing 30 for discharging the finished fiber pulp. Within the interior of the grinding housing, a pressure is maintained which is controlled by a sensor 54. The open discharge area of the blow valve 52 is adjusted by means of a servo motor 56, in which reciprocates a piston 58 which is connected to the movable body of the blow valve 52. The servo motor is supplied with pressure medium through the conduits 62, which terminate at each side of the piston 58 and are connected to a regulator 64. The latter communicates with a source of pressure medium through the conduit 66 and is actuated by a sensor 54 through conduit 68. By means of this arrangement, a predetermined overpressure level can be maintained in the grinding housing 30.

After the material to be ground has been compressed in the throat 11 and/or the pressure member 27, it advances further through a pipe 70 suitably having a cylindrical bore, the free end of which is located closely adjacent the rotating grinding disc 40. Furthermore, the pipe 70 is arranged eccentrically relative to the axis of rotation of the grinding disc in order to enhance the breaking-up of the highly compressed plug before the pulp material is introduced into the grinding space 48 between the grinding discs. The plug may suitably be broken up by one or more vanes 72 on the disc 40 directly in front of the mouth of the pipe 70. The material is so compact when it is pressed forward in the pipe 70, that it must be broken up into its earlier condition by special means. As the pulp material is compressed, water contained therein is simultaneously pressed out, so that the material will acquire a dry content of up to 50% and even higher. This high consistency is not suitable for grinding, and, therefore, water must be added to the interior of the grinding space through one or more conduits 74. Additionally, water may be introduced into the grinding space directly at one or more radially spaced locations, as denoted by the arrows 76.

As the pulp material is compressed by the compressor means 22, 27, a plug of compacted material is formed in the bore of the pipe 70, which prevents passage of steam therethrough. Furthermore, the material has a temperature which is so low that the middle lamellae, which bond the fibers together, lie below or on the lower portion of the softening curve. The material may thus have a temperature ranging from somewhat above room temperature and upwards to 100° C. This implies that, when the material is passed out into a first zone or portion of the grinding space 48 between the two grinding discs 38, 49 and is there subjected to the high working pressure between the discs, which rotate at high peripheral speed relative to one another, the middle lamellae and the fiber walls located therewithin will separate or unravel while the middle lamellae are still semi-solid and therefore have not yet reached or exceeded their softening point, where they become sticky or converted into semifluid state.

During the grinding operation, the dry content of the material should be high, just as in the aforementioned thermo-mechanical process, namely 15%–40%, which is regulated by the addition of water at locations 74 and/or 76.

By reason of the high working pressure and the great energy consumption, an environment of steam of superatmospheric pressure is generated in the inner portion of the grinding space, which, because of the sealed connection, can not penetrate rearwardly in the direction of movement of the material, but flows instead into the grinding housing, from which it is withdrawn and discharged together with the ground material through conduit 50 and blow valve 52.

In the outer portion of the grinding space, the fiber material comes in contact with an environment of steam which has a temperature higher than that of the material in the inner grinding zone, so that fibrillation of the pulp can be carried out under most favorable conditions. The pressure and attendant temperature of the steam environment in the grinding housing can be varied by adjustment of the blow valve 52 and sensor 54.

The discharge conduit 50 may be connected to a cyclone 80, where the ground fiber pulp is separated from the accompanying steam.

The space between the grinding housing and the bore of pipe 70, in which the steam-tight plug is maintained and advanced towards the disintegrating means 72 on the grinding disc 38, is sealed from the outside by means of a sleeve 82, so that steam cannot leak out between the throttling flaps 28.

According to the invention, properties suitable for different applications of use can be imparted to the pulp by varying the temperature and pressure of the steam in the grinding housing. Thus, if the steam temperature above 100° C. is selected within the range of 115° C.–135° C., a thermo-mechanical pulp of optimum fibrillation is obtained. On the other hand, if the temperature should exceed 135° C., the pulp fibers will unravel and separate without any appreciable fibrillation.

The powerful compression of the starting material, such as chips, ahead of the grinding apparatus produces a preliminary treatment and softening of the material to a certain degree, which favorably affects the subsequent grinding process. In the event chemicals such as bleaching compositions should be added to the starting material, the compressing feeding system according to the invention can even serve to uniformly distribute the liquid and separate out the undesired surplus.

Feed screws which simultaneously compress the fiber material are known per se and have been used for a long time for removing water and air from the pores of the material before impregnation with chemicals. When the pressure is subsequently released while the compressed material is submerged in the liquid chemical solution, the latter will be sucked into the pores so that the fiber material will become thoroughly impregnated. In this connection, however, it is not a question of creating a steamtight plug of the wood chips to prevent blow-back of superatmospheric steam generated in the grinding apparatus.

Obviously, the invention is not limited to the disclosed embodiments, but may find a variety of expressions within the scope of the inventive concept. Thus, it is conceivable to subject the steaming chamber to superatmospheric pressure, which may be accomplished by introduction of a non-condensable gas, such as air, of proper temperature and pressure, so that the chips also in this case are heated to a temperature below that of the temperature prevailing in the final step of the subsequent grinding process. Steam generated in the grinding apparatus and withdrawn from the latter through a conduit connected to the interior of the grinding housing, either ahead of or behind the grinding space, in the direction of flow between the grinding discs, may be used for preheating the chips.

I claim:

1. In the method of producing thermo-mechanical pulp in which ligno-cellulose fiber material such as wood chips is disintegrated in a grinding space defined between a pair of grinding discs which rotate relatively to one another under axial pressure within a defibrating housing in a steam environment of superatmospheric pressure and elevated temperature about 100° C., the wood chips being conveyed through the inlet in the grinding housing into a central opening between the grinding discs, from which the material is propelled radially outwards into the grinding space by the centrifugal force created by the rotating discs, the resultant ground pulp material being discharged from the defibrating housing through valve means which are controlled to maintain a predetermined pressure and temperature within the housing, the improvement in said method providing enhanced fibrillation with reduced energy consumption, comprising the steps of:

(a) conveying the wood chips into a passage to the inlet of the grinding space;

(b) compressing and dewatering the chips to a sufficient consistency to form a steam-tight plug at the inlet to said grinding housing to seal the latter against blow-back of pressurized steam into said passage;

(c) advancing said steam-tight plug through said inlet into said central opening at a temperature below 100° C.;

(d) breaking up said steam-tight plug at the grinding disc opposite the incoming plug before propelling the resultant fiber material into the grinding space; and (e) maintaining the temperature in the radial inner portion of the grinding space up to the softening point of the middle lamella to cause the pulp fiber walls to unravel and separate without any substantial fibrillation thereof as they are propelled through said inner radial portion of the grinding space to be subsequently fibrillated under the generation of high-temperature steam as they are propelled further through an outer radial portion of the grinding space.

2. The method according to claim 1, in which the temperature in the outer portion of the grinding space is not higher than 135° C.

3. The method according to claims 1, wherein water is added into the interior of the grinding space immediately before the material is subjected to the grinding process in the grinding space.

* * * * *